United States Patent [19]

Schaffan

[11] 4,260,104

[45] Apr. 7, 1981

[54] CURVABLE TRACK FOR MODEL RAILROADS

[75] Inventor: Stephan J. Schaffan, Hillside, N.J.

[73] Assignee: Atlas Tool Company, Hillside, N.J.

[21] Appl. No.: 48,242

[22] Filed: Jun. 13, 1979

[51] Int. Cl.[3] ..... A63H 19/30

[52] U.S. Cl. ..... 238/10 E

[58] Field of Search ..... 238/10 R, 10 A, 10 B, 238/10 C, 10 E, 10 F; 104/60, DIG. 1; 46/1 K, 216

[56] References Cited

U.S. PATENT DOCUMENTS

| | | | |
|---|---|---|---|
| 2,703,204 | 3/1955 | Miller | 238/10 E |
| 3,684,173 | 8/1972 | Casadio | 238/10 E |

FOREIGN PATENT DOCUMENTS

| | | | |
|---|---|---|---|
| 666666 | 7/1963 | Canada | 238/10 C |
| 1916937 | 10/1970 | Fed. Rep. of Germany | 238/10 E |
| 2220177 | 11/1973 | Fed. Rep. of Germany | 238/10 E |
| 1255076 | 1/1961 | France | 238/10 E |
| 818627 | 8/1959 | United Kingdom | 238/10 C |

*Primary Examiner*—Randolph A. Reese
*Attorney, Agent, or Firm*—Bruce L. Lamb

[57] ABSTRACT

Improved curvable track for model railroads in which a track bed of simulated crossties is formed as an integral flexible structure by linking the ties with a continuous web underlying the rail on one side of the track. Opposite the continuous web and underlying the other rail of the track, the ties are linked in alternate pairs. The rail of the track overlying the continuous web of the crosstie bed is secured thereto by simulated spikes against both lateral and longitudinal movement while the opposite rail overlying the alternately linked tie pairs is secured by simulated spike heads only against lateral movement and is free to move longitudinally with respect to the tie bed.

10 Claims, 11 Drawing Figures

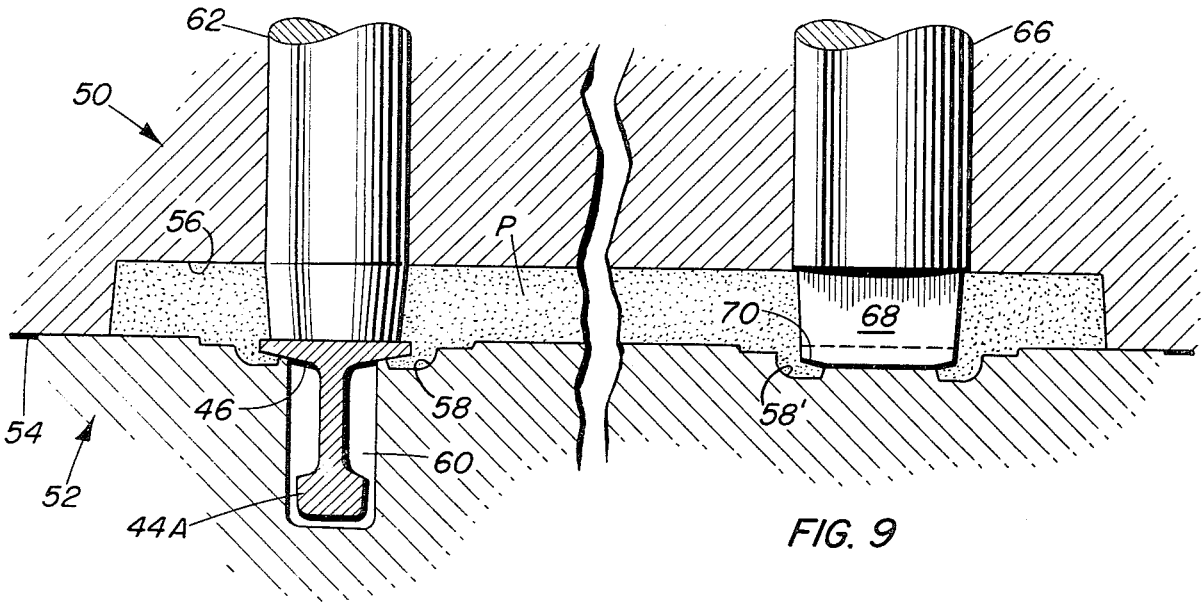
FIG. 9
FIG. 10
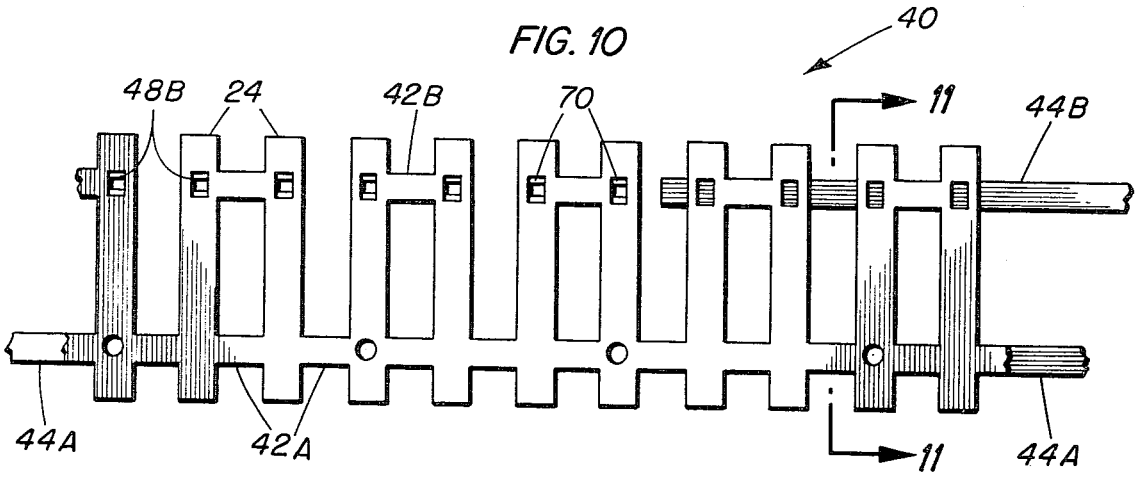
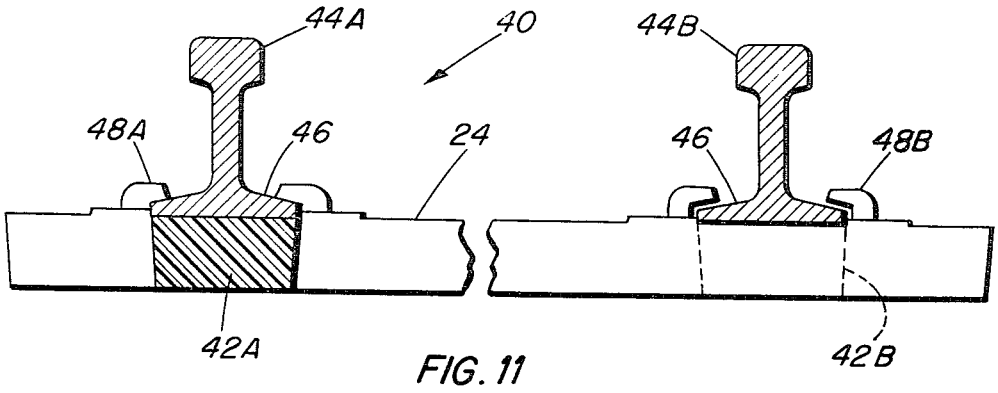
FIG. 11

CURVABLE TRACK FOR MODEL RAILROADS

The present invention relates to track for model railroads. More particularly, it relates to model railroad track constructed in sections of preformed rail pairs and securing ties which may be bent by the user into a required curve and which is distinguished from apparently similar prior products by improved properties of deformability, flexibility, restorability to original shape and ease of installation and repair.

The serious model railroad hobbyist is insistent upon constructing a track layout providing the maximum possible length, complexity and variety of operation for his railroad, within the confines of available space. He cannot achieve freedom to design a track layout having these attributes using only track sections preformed to a limited number of standardized curvatures and must often resort to forming portions of his layout from curvable track sections which may be shaped by hand to non-standard curves, spiral easements, etc. Heretofore, available curvable track sections have comprised a pair of rails secured to bed of simulated crossties which have been made flexible or bendable by various deformable linkages between the crossties. The rails in such prior art track sections have either both been secured to the ties against relative lateral movement, thereby maintaining parallelism, but free to slide longitudinally, or they have both been substantially rigidly secured to the ties against both lateral and longitudinal movement. The shortcomings of the prior art track of these sorts will be described hereinafter with reference to the drawings.

The track of the present invention likewise includes a bed of flexibly interlinked crossties. Its distinguishing feature is that one of the rails of the pair is secured to the crosstie bed against both lateral and longitudinal movement while the other rail of the pair is secured to the bed only against lateral movement and is free to slide longitudinally relative thereto. The advantages attendant to such construction conform to the objects of the invention, among which are the following.

It is an object of the invention to provide curvable model railroad track which may easily be shaped by hand into a desired curve and which retains proper track gauge after shaping.

It is another object of the invention to provide curvable track sections which may be easily coupled together with staggered rail joints.

It is still another object of the invention to provide a curvable track section in which one rail is moveable longitudinally relative to the other and which may be readily reassembled should the moveable rail become detached from its supporting crossties.

Other objects of the invention will become apparent as a full understanding thereof is gained from the complete description to follow.

BRIEF DESCRIPTION

Briefly, the invention comprises curvable model railroad track in which one rail is securely fastened to a bed of crossties against both lateral and longitudinal movement relative to the ties. The opposite rail of the track is secured to the crosstie bed only against lateral movement and is free to slide longitudinally relative to the crosstie bed and the first mentioned rail. Preferably, but not necessarily, the ties of the crosstie bed are linked continuously together along the side of the fully secured rail and are linked only alternately one to the other along the side of the slidable rail.

THE DRAWINGS

FIG. 9 is a cross section of a two-part mold used to manufacture the crosstie bed with a single secured rail according to the invention;

FIG. 10 is a bottom view of the track of the invention; and

FIG. 11 is a cross section of the track of the invention.

DETAILED DESCRIPTION

Figures 1, 2, 3, 4, 5, 6, 7, 8:
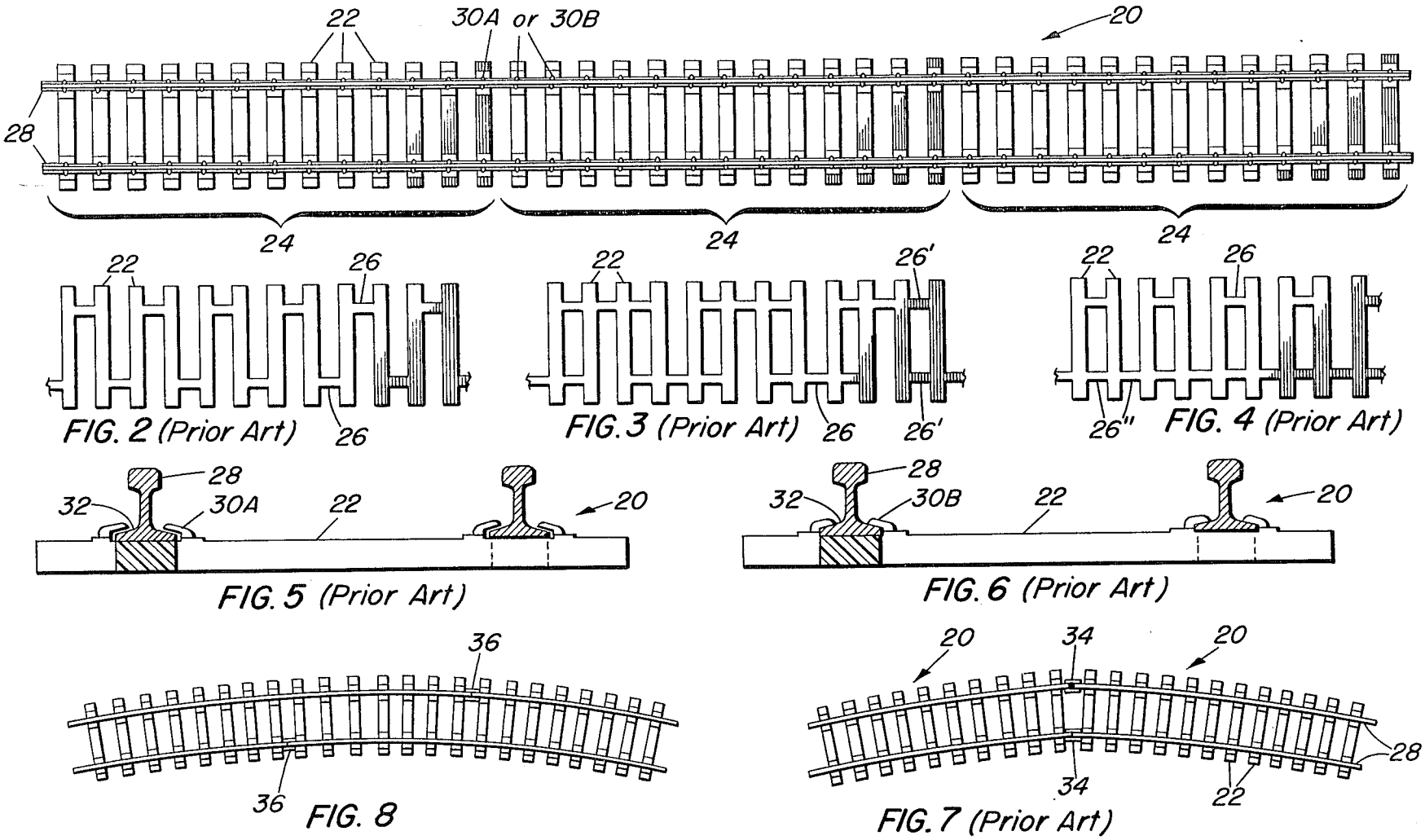
FIG. 2 (Prior Art)
FIG. 3 (Prior Art)
FIG. 4 (Prior Art)
FIG. 5 (Prior Art)
FIG. 6 (Prior Art)
FIG. 7 (Prior Art)
FIG. 1 is a plan view of a typical section of curvable model railroad track.
FIGS. 2, 3 and 4 are bottom views of various known crosstie beds showing different means of interlinking the ties to provide flexibility in a unitary structure.
FIG. 5 is a cross section of prior curvable track in which both rails are free to move longitudinally.
FIG. 6 is a cross section of prior curvable track in which both rails are fixed to the crosstie bed.
FIG. 7 is a plan view of two curved sections of track connected together with opposed rail joints.
FIG. 8 is a plan view similar to FIG. 7 except that the rail joints are staggered.

FIG. 1 is typical of the appearance of a preformed track section comprising rails 28 attached to a unitary bed of crossties 22. The preformed track structure of rails secured to the crosstie bed provides obvious conveniences in the construction of a smooth, properly aligned track system for a model railroad. The appearance simulates actual railroad track wherein individual rails are secured to individual ties by spikes. The unitary nature of the crosstie bed of FIG. 1 is concealed by the fact that the tie spacers linking the ties underlie the rails and they cannot be seen from any normal viewing angle, as it is intended. FIG. 1 can be illustrative either of a rigid straight track section or a curvable track section either of the present invention or of the prior art since the differences between the invention and the prior art are not evidenced by appearance. Customarily, the track section is formed by molding a pair of spring brass rails of about 36 inches length to the plastic crosstie bed which is divided into segments 24 of linked crossties. The manner of linking the crossties may assume different forms, as will now be described.

FIGS. 2, 3 and 4 are bottom views of shortened segments of unitary crosstie beds which have been used in curvable track of the prior art, and any of which may be used in the present invention, although as will later be seen, the pattern of FIG. 4 is preferred herein. It will be understood that, ideally, in forming any curve the spacing of the rails must be maintained at the specified gauge. Thus it is implied that at any particular point on the curve the rails must possess a common center of curvature and that the difference between the radius of curvature for each of the rails amounts to the track gauge. The crossties then will lie on radii converging at the center of curvature and the ties will be uniformly spaced on the inner arc and uniformly but greater spaced on the outer arc of the curve. To permit the ties to form into the required fan-like disposition, both rails should be slidable and pivotable relative to each of the ties. Practice falls short of the ideal, however, but not severely. The ties of a segment may be alternately linked at opposite ends, as in FIG. 2. Doubly linked pairs may be singly linked at opposite ends, as seen in the double links 26′ and the single link 26 of FIG. 3. In still another arrangement, as in FIG. 4, the tie links 26″ along one side are continuous while on the opposite side the links 26 connect only pairs of ties. In all of the arrangements of FIGS. 2–4, the plastic material of which the ties and links are molded is sufficiently flexible to permit some hinge bending at the joints between the ties and the links. When bent into a curve, the ends of the ties of the bed of FIG. 2 which are connected by links will remain substantially at constant spacing while the unconnected tie ends on the inner arc of the curve move closer together and those on the outer arc move farther apart. In a curve formed of the structure of FIG. 3, the spacing between tie ends connected by links remains substantially constant and the spacing between unlinked tie ends will be taken in on the inner arc and let out on the outer arc at intervals of every fourth tie but these intervals alternate from side to side between linked pairs of ties so that only pairs of ties are constrained in parallel. In a curve formed of the structure of FIG. 4, the disposition of the ties approximately along the curve radii is allowed by the increase or decrease of the spacing between the unlinked tie ends which occurs only on one side of the curve, providing an array of substantially the same accuracy as the structure of FIG. 3.

In the prior art track formed of any of the tie beds of FIGS. 2, 3 or 4 it has been the practice either to mold the tie beds with neither rail in place at the time of molding, or to mold the tie beds with both rails in place at the time of molding. These practices lead to the track structures shown in the cross sectional track views, FIGS. 5 and 6.

In FIG. 5, the tie bed has been molded with neither rail in place. Sufficient clearance has been provided between the upper surface of the tie 22 and the lower inward surfaces of the spike heads 30A so that both rails 28 may be slid into place with the aid of an alignment jig which maintains the ties perpendicular to and properly aligned with the path of the rails as they are being inserted. After assembly a small clearance remains between the base flanges 32 of each of the rails and the lower inward surfaces of the spike heads and both rails are free to slide relative to the ties, providing a track which is quite flexible. In the hands of the user, however, one or both rails frequently slide out of place during cutting, bending or installation of the track. It then becomes a tedious and frustrating task to reassemble the rails to the ties since the ties will move laterally out of alignment and, because of their freedom to slide and to pivot a limited amount relative to the rails, the tie bed may even become compressed or expanded in accordion-like fashion longitudinally along the track.

In FIG. 6 the track is formed by molding the tie bed with both rails in place. In the resulting track no clearance exists between the rail flanges 32 and the lower inward facing surfaces of the spike heads 30B. Substantial frictional forces are thereby created between the tie bed and the rails which permit sliding movement of the individual rails relative to the tie bed, as is necessary in shaping a curve, only with difficulty. The track is therefore quite stiff and cannot be bent into as tight a curve as can the more flexible track of FIG. 5 and of the present invention. Although the rails of the track of FIG. 6 are not likely to become inadvertently disassembled from the ties, should they be, reassembly is virtually impossible. The inability to slide the rails along the ties leads to difficulties in constructing a smooth running model railroad, as will now be described with reference to FIGS. 7 and 8.

The rails of curvable track being of spring-like material tend to return to a straight condition when the track is flexed. Thus when the track is joined either to a straight track section at the tangent to a curve or to a curved track section in the continuation of a curve, the normal tendency of the rails to return to a straight position causes a gap to appear at the outer joint of a curve as in 34 of FIG. 7. It should be noted that track sections are usually and conveniently joined by means of slotted clips which fit over portions of the base flanges of the facing rails, binding the rails against longitudinal movement. The joiner clips, however, provide insufficient resistance to lateral forces to prevent the formation of gaps and kinks as appear in FIG. 7. Such gaps and kinks cause shocks to the rolling stock as a train runs through the curve and often causes derailments or car uncouplings or upsets. Moreover, even track with a tolerable gap when installed often degrades through use to the point of unserviceability because the wheels of the train will pick at the joint causing dislodgement of the rails and further opening of the gap.

Modelers have long known of the desirability of staggering the rail joints in a curved section of track, as at 36 in FIG. 8, particularly when using track of a resilient nature. Then the continuous portion of rail opposite each joint and the mutual constraining forces of the continuous rail and the ties, transmitted through the ties to the rail ends at the joint, hold the rail ends into close alignment at the joint. A train rolling on such track will run smoothly through the curve, there being no gaps or kinks to cause shocks and derailments of the rolling stock.

Track section connections with staggered joints are formed by extending one rail beyond its associated tie bed and retracting the other rail within its tie bed. The rails of the abutting track section are likewise extended and retracted with respect to its tie bed except that the rail of the abutting section opposite the extended rail of the mating section is the one retracted while the extended rail of abutting section meets the retracted rail of mating section. The extended rails of the connected sections then project into and occupy the spaces provided by the retracted rails.

Extending and retracting the rails of the prior art type of track of FIG. 5 wherein both rails are free to slide longitudinally of the tie bed presents no difficulty. However, because the rail opposite the joint to be formed does not constrain the tie bed adequately for precise alignment with the entering rail, it becomes a painstaking task to install the extended rails of the mating sections in the positions occupied by the retracted rails. Nevertheless when connection of the track sections is finally accomplished the staggered joints thereof will be properly constrained so as to eliminate kinks and gaps.

Connections between track sections of the prior art type of FIG. 6, wherein both rails are secured to the tie bed, are seldom made with staggered joints. Since neither rail can be extended or retracted, forming a connection with staggered joints involves cutting and removing a portion of the opposite rails of the sections to be connected, the lengths of the removed portions of the rails corresponding to the distance along the track between the rail joints. The ties are completely removed from the unshortened rail of one of the sections while they are allowed to remain secured to the unshortened rail of the other section. Before the connection is made, one of the track sections will show a rail projecting beyond the crosstie bed clear of all ties while the other track section will show a longer rail with ties attached, which longer rail will be on the side of the track opposite the side of the freely projecting rail. When these track sections are connected together, even though the rail joints will be staggered, the freely projecting rail will not be constrained against lateral movement by the tie bed and a kink or gap will most likely result at the joint of the freely projecting rail, depending on whether the joint is on the inside or outside of a curve.

FIGS. 10 and 11 illustrate the track of the invention. As best seen in the bottom view of FIG. 10, the ties 24 are linked into a flexible, unitary bed by a continuous web 42A along one side and are connected in pairs by alternating links 42B along the opposite side. The links 42B and web 42A underlie the rails 44A and 44B and are concealed from view by the rails when the track is placed in position for use. Rail 44A overlying the web 42A is secured to the tie bed against lateral and longitudinal movement relative thereto by the simulated spikes 48A (FIG. 11) molded closely to the rail base flange 46 as integral parts of each of the ties 24. Rail 44B overlying the links 42B and the free ends of the ties is slidingly received along the base flange 46 thereof in the clearance space provided between the top surfaces of the ties and the downward inwardly facing surfaces of the simulated spikes 48B. Rail 44B is constrained against lateral movement thereby maintaining proper gauge when the track is bent into a curve but is free to move longitudinally thereby allowing the spaces between the unlinked underlying tie ends to increase or decrease the necessary amount to permit the ties to lie substantially along radii of a curve.

The track of the invention is manufactured by a molding process using a split mold shown in cross section in FIG. 9. Mold piece 52 is provided with a cavity 60 in which rail 44A is placed in inverted position with the rail flange 46 sealing the cavity 60. Shallow cavities 58 and 58' extending from the top surface of mold piece 52, which is also the parting line 54, are shaped in the impression of the spike heads 48A and 48B. The mold piece 50, mating with mold piece 52, has formed therein a plurality of spaced tie cavities 56 extending perpendicularly to the rail cavity 60. A continuous lengthwise cavity (not shown) in mold piece 50 extends parallel to rail cavity 60 and overlies the same when the mold is closed. The continuous lengthwise cavity of mold piece 50 communicates with each of the tie cavities 56 therein to form the web 42A. Interrupted cavities (not shown) also extend in mold piece 50. The interrupted cavities communicate with alternate ones of the tie cavities 56 to form the links 42B. A plurality of hold-down pins 62 carried by mold piece 50 are spaced along the center line of the continuous lengthwise cavity at distances equal to several times the spacing between the tie cavities. Core pins 66 carried by mold piece 50 extend downwards into each of the tie cavities 56. The ends 68 of core pins 66 are rectangular in section and directly contact the upper surface of mold piece 52 at a depth sufficient to provide free sliding clearance between the base flange of rail 44B, when the rail is later installed, the top surfaces of the ties along the line 54 and the flange facing surfaces 70 (FIG. 10) of the spikes 48B.

Manufacturing the track of the invention involves depositing the rail 44A in the cavity 60, closing the mold whereupon the pins 62 hold the rail 44A in place, sealing cavity 60, and injecting plastic P to form the crosstie bed. The crosstie bed with the rail 44A adhering thereto is withdrawn from the mold and the rail 44B is slid into place.

Track made in accordance with the invention can easily be formed into any curve through which a model train, limited by car clearances and the like, is capable of rolling. The track sections can easily be connected together with staggered rails joints and both rails thereof will be properly constrained by the crosstie bed so as to eliminate kinks and gaps at the joints and, because the secured rail maintains proper alignment of the crosstie bed, the slidable rail can be removed and reinstalled with no difficulty.

It should be understood that within the scope of the appended claims the invention may be practiced otherwise than as specifically described without departing from the spirit of the teachings herein.

The invention claimed is:

1. Curvable track for model railroad use comprising:

a plurality of simulated crossties;

means flexibly interconnecting said crossties to form a unitary flexible bed of crossties;

a first rail extending transversely to said crossties of said bed and secured to said bed against lateral and longitudinal movement with respect to said bed;

a second rail, said second rail being spaced laterally from and extending parallel to said first rail; and means securing said second rail to said crosstie bed against lateral movement with respect to said bed, said second rail being free to move longitudinally with respect to said bed.

2. Curvable model railroad track as claimed in claim 1 wherein said means flexibly interconnecting said crossties include a continuous web underlying said first rail.

3. Curvable model railroad track as claimed in claim 2 wherein said means flexibly interconnecting said crossties further include a plurality of links intermittently connecting ends of said crossties opposite said web.

4. Curvable model railroad track as claimed in claim 3 wherein said links underlie said second rail.

5. Curvable model railroad track comprising;

a unitary, flexible crosstie bed including a plurality of crossties extending transversely to and spaced longitudinally along the length of the track, a continuous flexible web spaced inwardly from the ends of said crossties along one side of the track and extending longitudinally along the length of the track to interconnect said ties into a comblike structure and a plurality of links spaced inwardly from the ends of said crossties farthest from said web to form spaced connections between said farthest crosstie ends;

a first rail;

means securing said first rail to said crosstie bed against lateral and longitudinal movement with respect to said bed in a position overlying said web;

a second rail spaced laterally from said first rail an amount equal to the track gauge; and means securing said second rail to said crosstie bed against lateral movement with respect to said bed, said second rail being free to move longitudinally with respect to said bed.

6. Curvable model railroad track as claimed in claim 5 wherein said crosstie bed is formed of molded plastic material.

7. Curvable model railroad track as claimed in claim 6 and wherein said first and second rails are substantially I-shaped in cross section providing rail base flange portions and said means securing said first rail to said crosstie bed include simulated spikes molded integrally with said crosstie bed to engage said base flange of said first rail.

8. Curvable model railroad track as claimed in claim 7 and said means securing said second rail to said crosstie bed include simulated spikes molded integrally with said crosstie bed to embrace the base flange of said second rail and constrain said second rail against lateral movement relative to said bed.

9. Curvable model railroad track as claimed in claim 8 wherein said crosstie bed is formed with aid of a mold having cavities therein in the impression of said crossties and spikes and a cavity in which said first rail is deposited prior to molding said crosstie bed, and after injection of plastic material in mold, said crosstie bed and said first rail are withdrawn from said mold as a unitary structure.

10. Curvable model railroad track as claimed in claim 9 wherein said mold from which said track is shaped includes a plurality of core pins extending through each of the cavities for the crossties to provide clearance spaces into which said second rail may be inserted.

* * * * *